US007219672B2

(12) United States Patent
Tosas Fuentes et al.

(10) Patent No.: US 7,219,672 B2
(45) Date of Patent: May 22, 2007

(54) METHOD OF PREPARING PAPER FOR SELF-EXTINGUISHING CIGARETTES

(75) Inventors: Agusting Tosas Fuentes, Barcelona (ES); Pablo De Mariscal Ruigomez, Barcelona (ES)

(73) Assignee: Miquel Y. Costas & Miquel S.A., Barcelona (ES)

( * ) Notice: Subject to any disclaimer, the term of this patent is extended or adjusted under 35 U.S.C. 154(b) by 272 days.

(21) Appl. No.: 10/398,310

(22) PCT Filed: Aug. 13, 2001

(86) PCT No.: PCT/ES01/00323

§ 371 (c)(1),
(2), (4) Date: Jul. 17, 2003

(87) PCT Pub. No.: WO03/015543

PCT Pub. Date: Feb. 27, 2003

(65) Prior Publication Data

US 2004/0020502 A1 Feb. 5, 2004

(51) Int. Cl.
*A24D 1/02* (2006.01)

(52) U.S. Cl. ..... 131/365; 162/139; 162/134; 162/135

(58) Field of Classification Search ..... 131/365; 162/139, 134, 135
See application file for complete search history.

(56) References Cited

U.S. PATENT DOCUMENTS 4,489,738 A * 12/1984 Simon ..... 131/349
4,942,888 A * 7/1990 Montoya et al. ..... 131/359

FOREIGN PATENT DOCUMENTS

| | | | |
|---|---|---|---|
| DE | 24 29 783 | | 1/1975 |
| EP | 0193607 | * | 9/1986 |
| EP | 0758695 | * | 2/1997 |
| GB | 1 471 943 | | 4/1977 |

OTHER PUBLICATIONS http://www.chemfinder.com: "gum arabic" entry.*

* cited by examiner

*Primary Examiner*—Dionne W. Mayes
(74) *Attorney, Agent, or Firm*—Michaelson & Associates; Peterson L. Michaelson; Arthur L. Liberman

(57) ABSTRACT

A method is described for the manufacture of a paper for self-extinguishing cigarettes, by reducing its permeability to air, obtained by applying continuously or onto well defined areas, a composition based on gum Arabic or acacia gum, with or without a fire retardant filler, the application of which is carried out by printing techniques such as serigraphy, heliogravure, flexography or off-set. The concentration of the gum arabic or acacia gum in said composition may vary between 0.15% and 50% by weight, while the amount of product deposited onto the cigarette paper may vary between 0.5 g/m$^2$ and 10 g/m$^2$, by weight.

14 Claims, No Drawings

METHOD OF PREPARING PAPER FOR SELF-EXTINGUISHING CIGARETTES

OBJECT OF THE INVENTION

The present invention refers to a method of preparing paper for self-extinguishing cigarettes, providing essential features of novelty and important advantages with respect to the processes known and used for the same purposes in the current state of the art.

More specifically, the procedure of the invention develops a process by means of which a paper for cigarettes is provided with a suitable coating preferably on its internal face, or face in contact with the tobacco, in areas or continuously, using printing techniques, and obtained from a solution prepared from gum arabic or acacia gum, alone or in combination with a filler as it is convenient, and with which the permeability of the paper to air is changed to achieve the self-extinction feature.

The field of application of the present invention includes the industrial sector dedicated to the manufacture of products to be smoked and especially, of paper for cigarettes.

BACKGROUND AND SUMMARY OF THE INVENTION

Many documents and processes related to the manufacture of self-extinguishing cigarettes are known in the current state-of-the-art. The endowment of this feature to a cigarette is conventionally obtained by means of the of the application of some type of coating onto the cigarette paper, intended to modify the air permeability of the paper and in which both the type of the coating applied and its viscosity play an important role in the results obtained.

In order to obtain the above-mentioned goals two methods of treatment of the cigarette paper are known, as indicated below:

1) The first method consists of applying the coating uniformly onto the entire cigarette paper surface, such that all the paper has a reduced tendency towards combustion;
2) the second method consists of applying the coating on the surface of the cigarette paper only in previously defined areas, i.e., to create areas with a reduced capacity of combustion alternating with others with a normal tendency of combustion.

Within each one of the above-mentioned methods of treatment to obtain a paper adapted to a self-extinguishing cigarette, various methods to obtain the proposed goals may be considered.

The first method (related to a uniformly covered cigarette paper, that is, with a low on its whole area ignition propensity, has a drawback that the air permeability of the paper is low, so that the content of toxic substances in the smoke is high. Moreover, another drawback of this method is that the combustion of cigarettes so manufactured is deficient: for example, black ashes are produced as well as an uneven and generally thicker than desirable combustion ring.

As of the second method, its main objective consists in reducing the air permeability of the paper in determined areas only, such that the combustion in these areas is reduced considerably. This effect may be obtained by different methods, such as, for example, by using a strong calendaring, by applying specially treated cellulose fibres, or with substances melting at a high temperature, by using certain hydrosoluble or liposoluble polymers, etc.

The main object of the present invention, consists in obtaining a cigarette paper adapted to the requirements of a self-extinguishing cigarette, by using components that do not affect its taste negatively and that besides, reduces the possibilities of ignition of the flammable materials that may enter in contact with it.

This objective has been totally reached achieved with the cigarette paper obtained by with the process of the present invention and by means of which the paper is manufactured, preferably on its internal side, with a suitable coating distributed continously or by areas, as convenient, using printing techniques where the printing "ink" consists, as it has been found extremely beneficial and contrary to the experience of the previous state-of-the-art, of a solution obtained from gum arabic or acacia gum dissolved in water, with or without fillers added.

On the other hand, it has been determined that the addition of a fire retardant filler to the composition helps to reduce the air permeability of the paper, without excessively affecting its viscosity, being the most preferred fire retardant filler those the ones coming from among those in the group consisting of aluminium hydroxide, calcium sulphate or magnesium hydroxide.

DESCRIPTION OF A PREFERRED EMBODIMENT

According to the present invention, the procedure allowing the preparation of a paper for self-extinguishing cigarettes comprises several stages, as explained below.

The first stage of the procedure consists in preparing the composition that will be used as the coating, applied continuously or in areas, preferably on the face of the paper in contact with the tobacco. Said composition is obtained by dissolving a predetermined amount of gum Arabic or acacia gum in water, in concentrations varying from 0.15% and 60% and preferably, between 0.5% and 55%, or even better, between 0.65% and 50%. In practice, the preferred concentration of acacia gum in the composition is about 15% to 30%.

If this composition incorporates any fire retardant filler, said material is added in the second stage of the process, its specific amount depending on its nature. Therefore, suitable amounts of filler are about 10% aluminum hydroxide, while the rest of the composition consists of water until completing 100%.

However, other products exist that may be beneficially combined with gum arabic or acacia gum without excessively affecting its viscosity. This is so because of their fire retardant properties and their capability to reduce the air permeability property of the paper, with the subsequent increase of the self-extinguishing properties of the cigarette. Particularly, these other preferred products may consist of magnesium hydroxide or calcium sulphate at concentrations comprised within the range of 0.25% to 50%, preferably 2% to 40% and most preferably, 3% to 35%.

Once the desired composition or "ink" able to be applied onto the cigarette paper has been manufactured it is applied onto the internal face of the paper, over its total surface area, either by areas or uniformly.

According to the present invention, the composition usable as an "ink", may be deposited over the cigarette paper by techniques such as serigraphy, heliogravure, flexography or off-set, although it is preferred to use flexography continuously or in strips, using a transfer roller, designed for a correct transfer of the "ink" to the cigarette paper. According to the invention, this "ink" is to be in a way applied onto the paper in concentrations ranging from 0.5 g/m$^2$ to 10 g/m$^2$ of paper and preferably from 1.5 g/m$^2$ to 9 g/m$^2$ of paper and more preferably from 3 g/m$^2$ to 7 g/m$^2$ of paper.

Specific factors exist which decisively influence the features of the self-extinguishing paper obtained by applying the aforementioned techniques, such as the intrinsic characteristics of the base paper used, the nature of the materials applied onto it and the actual amount deposited.

A very important parameter to be taken into account when printing a paper by any method, is the viscosity of the ink. In heliogravure and flexography, there is a viscosity limit above which the transfer of the ink to the contact screen is hindered. Moreover, a high ink viscosity causes a loss of definition of texts and small drawings. Therefore, when selecting a binder, besides its specific effect of reducing the air permeability of the paper, its ignition tendency and its influence over cigarette taste, the corresponding limitation of viscosity should also be taken into account. As there is a direct relationship between the solid content of a solution and its viscosity, the viscosity limit is interpreted as a limit to the solids in the ink and therefore, a limit to the amount of material applied to the paper.

The materials suitable for the present invention consist in a group composed of starch, guar gum, sodium alginate, hydroxypropylmethylcellulose, methylcellulose, sodium carboxymethylcellulose and gum arabic or acacia gum.

For purposes of comparison, nitro-cellulose has been evaluated with triacetine as a plasticizer combined with calcinated kaolin in the TABLE, infra.

Also for purposes of comparison, starch, guar gum, sodium alginate, hydroxypropylmethylcellulose, methyl cellulose, and sodium carboxymethylcellulose have been evaluated as set forth in the TABLE, infra.

The ink application system includes the use of rods with different concentrations of ink application. These rods apply the ink onto the wire side of the paper, that is to say, the face of the paper to be in contact with the wire of the paper machine upon its production, and it is the face which will be in contact with the tobacco when the cigarette is manufactured.

A table is shown below which shows the results of the application of the above-mentioned ink onto the cigarette paper by measuring the air permeability of the paper before and after applying the ink. The free combustion of the cigarettes made with standard tobacco, and the combustion of those cigarettes when in contact with ten sheets of laboratory filter paper (ash free filter paper, La Papelera de Besós, ref. 438, 15 cm diameter) was measured. The results are as follows:

TABLE

| Product | Concentration % | Liquid amount applied g/m2 | Initial paper permeability UC | Final paper permeability UC | Free cigarette burn | Cigarette burn over filter paper |
|---|---|---|---|---|---|---|
| Reference 1: Nitro-cellulose + calcinated Kaolin (Ansilex, Engelhart) | 10 + 30 | 7 | 33 | 11 | Yes | Yes |
| Reference 2: Nitro-cellulose | 32 | 7 | 32 | 3 | Yes | Yes |
| Starch (Perfectamyl P255, Avebe) | 4 | 11 | 35 | 28 | Yes | Yes |
| Guar gum (Meyprofilm 100, Meyhall) | 2 | 11 | 32 | 22 | Yes | Yes |
| Starch + sodium alginate (Perfectamyl P255, Avebe + Satialgine S60, SKW Biosystems) | 3.5 + 0.5 | 11 | 35 | 27 | Yes | Yes |
| Hydroxypropylmethyl cellulose (Methofas 65HPM450, ICI) | 1 | 11 | 32 | 14 | Yes | Yes |
| Hydroxypropylmethyl cellulose (Methofas 65HPM450, ICI) | 2 | 11 | 33 | 9 | Yes | Yes |
| Sodium carboxymethyl cellulose (Finnfix 1500, Noviant) | 2 | 11 | 34 | 14 | Yes | Yes |
| Sodium carboxymethyl cellulose (Wallocel MW50, Wolff Walsrode). Very high viscosity. | 6 | 7 | 31 | 0 | Yes | No |
| Sodium carboxymethyl cellulose (Blanose 7ULC, Hercules). Very high viscosity. | 10 | 11 | 35 | 22 | Yes | Yes |
| Sodium carboxymethyl cellulose (Blanose 7ULC, Hercules) Very high viscosity | 15 | 11 | 35 | 8 | No | No |
| Sodium carboxymethyl cellulose (Blanose 7ULC, Hercules) + Aluminium hydroxide (Martifin OL 107, Martinswerk). High viscosity | 7.5 + 7.5 | 11 | 34 | 14 | Yes | Yes |
| Sodium carboxymethyl cellulose (Blanose 7ULC, Hercules) + | 10 + 10 | 11 | 35 | 6 | Yes | No |

TABLE-continued

| Product | Concentration % | Liquid amount applied g/m2 | Initial paper permeability UC | Final paper permeability UC | Free cigarette burn | Cigarette burn over filter paper |
|---|---|---|---|---|---|---|
| Aluminium hydroxide (Martinfin OL 107, Martinswerk). High viscosity | | | | | | |
| Sodium carboxymethyl cellulose (Blanose 7ULC, Hercules) + Aluminium hydroxide (Martinfin OL 107, Martinswerk). Very high viscosity | 15 + 10 | 11 | 32 | 4 | Yes | No |
| Sodium carboxymethyl cellulose (Blanose 7ULC, Hercules) + Magnesium hydroxide. High viscosity | 10 + 10 | 11 | 35 | 11 | Yes | No |
| Sodium carboxymethyl cellulose (Blanose 7ULC, Hercules) + Magnesium hydroxide. High viscosity | 10 + 10 | 11 | 54 | 14 | Yes | Yes |
| Methyl cellulose (Methocel A15 FG, The Dow Chemical Co.) | 2 | 11 | 37 | 11 | Yes | Yes |
| Methyl cellulose (Methocel A15 FG, The Dow Chemical Co.) | 3.7 | 11 | 31 | 7 | Yes | Yes |
| Methyl cellulose (Methocel A15 FG, The Dow Chemical Co.) | 3.7 | 20 | 32 | 2 | Yes | Yes |
| Methyl cellulose + Aluminium hydroxide (Methocel A15 FG, The Dow Chemical Co. + Martinfin OL 107, Martinswerk) | 3.7 + 3.7 | 7 | 32 | 4 | Yes | Yes |
| Methyl cellulose + Aluminium hydroxide (Methocel A15 FG, The Dow Chemical Co. + Martinfin OL 107, Martinswerk) | 3.7 + 3.7 | 11 | 32 | 4 | Yes | Yes |
| Methyl cellulose + Aluminium hydroxide (Methocel A15 FG, The Dow Chemical Co. + Martinfin OL 107, Martinswerk) | 3.7 + 3.7 | 20 | 33 | 2 | Yes | Yes |
| Acacia gum. Spray Gum GD | 25.5 | 11 | 38 | 11 | No | No |
| Acacia gum. Spray Gum GD | 25.5 | 11 | 54 | 22 | Yes | No |
| Acacia gum Spray Gum GD + Aluminium hydroxide (Martinfin OL 107, Martinswerk) | 20 + 10 | 11 | 54 | 6 | No | No |

As it has been said above, inks with high or very high viscosities impair the use of the mentioned fillers due to practical reasons.

Likewise, on studying the table it is deduced that, both the type of material applied onto the cigarette paper and its concentration, are the parameters having the greatest influence in the self-extinction property of the cigarettes.

Polymers such as, for example, carboxymethyl cellulose, methylcellulose or acacia gum are normally used in the cigarette paper and tobacco industries as binders for tobacco leaves and papers, as in cigarette paper booklets, because their application is easy and their effect on the taste of the cigarette, is small.

In the specific case of arabic or acacia gum, the mixture with aluminium hydroxide enhances both, an additional reduction of the permeability of the paper to air and a reduction of its tendency to burn, even under free combustion circumstances. The viscosity of a water solution made up of 20% acacia gum and 10% aluminium hydroxide (wt/wt), measured in a number 4 Ford Cup at room temperature ranges from 40 to 60 seconds.

As it will be understood, the experts in the matter will be able to bring about multiple variations and modifications of the formulations described in the present invention, without altering the scope of the invention.

The invention claimed is:

1. A self-extinguishing cigarette comprising tobacco and, as a wrapper, a cigarette paper coated with a fire retardant and an air permeability-reducing coating, said cigarette paper having (i) an external face and (ii) an internal face which is in contact with said tobacco, characterized in that the coated cigarette paper is produced according to a process comprising the steps of:

(A) preparing an aqueous cigarette paper coating composition consisting essentially of (I) from 0.15% to 60% by weight of acacia gum; (II) from 0.25 to 50% by weight of a fire-retardant filler which is aluminum hydroxide; and (III) the remainder being water, with the proviso that the concentration of fire-retardant filler in the composition is insufficient to cause a substantial increase in the viscosity of the cigarette paper coating composition;

(B) providing an uncoated cigarette paper having an internal face and an external face;

(C) depositing the resulting aqueous cigarette paper coating composition onto the internal face of said uncoated cigarette paper in a concentration in the range of from 0.5 $g/m^2$ to 10 $g/m^2$ by means of a flexography printing technique in strips.

2. The self-extinguishing cigarette of claim 1 wherein in the process for producing the coated cigarette paper, the aqueous cigarette paper coating composition consists essentially of (I) from 0.5% to 55% by weight of acacia gum; (II) from 0.25% to 50% by weight of aluminum hydroxide and (III) the remainder being water.

3. The self-extinguishing cigarette of claim 1 wherein in the process for producing the coated cigarette paper, the aqueous cigarette paper coating composition consists essentially of (I) from 0.5% to 55% by weight of acacia gum; (II) from 2% to 40% by weight of aluminum hydroxide and (III) the remainder being water.

4. The self-extinguishing cigarette of claim 1 wherein in the process for producing the coated cigarette paper, the aqueous cigarette paper coating composition consists essentially of (I) from 0.5% to 55% by weight of acacia gum; (II) from 3 to 35% by weight of aluminum hydroxide and (III) the remainder being water.

5. The self-extinguishing cigarette of claim 1 wherein in the process for producing the coated cigarette paper, the aqueous cigarette paper coating composition consists essentially of (I) from 0.65% to 50% by weight of acacia gum; (II) from 0.25% to 50% by weight of aluminum hydroxide and (III) the remainder being water.

6. The self-extinguishing cigarette of claim 1 wherein in the process for producing the coated cigarette paper, the aqueous cigarette paper coating composition consists essentially of (I) from 0.65% to 50% by weight of acacia gum; (II) from 3% to 35% by weight of aluminum hydroxide and (III) the remainder being water.

7. The self-extinguishing cigarette of claim 1 wherein in the process for producing the coated cigarette paper, the aqueous cigarette paper coating composition consists essentially of (I) from 15% to 30% by weight of acacia gum; (II) from 0.25% to 50% by weight of aluminum hydroxide and (III) the remainder being water.

8. The self-extinguishing cigarette of claim 1 wherein in the process for producing the coated cigarette paper, the aqueous cigarette paper coating composition consists essentially of (I) from 15% to 30% by weight of acacia gum; (II) from 2% to 40% by weight of aluminum hydroxide and (III) the remainder being water.

9. The self-extinguishing cigarette of claim 1 wherein in the process for producing the coated cigarette paper, the aqueous cigarette paper coating composition consists essentially of (I) from 15% to 30% by weight of acacia gum; (II) from 3% to 35% by weight of aluminum hydroxide and (III) the remainder being water.

10. The self-extinguishing cigarette of claim 9 wherein in the process for producing the coated cigarette paper, the aqueous cigarette paper coating composition is deposited onto said uncoated cigarette paper in a concentration in the range of from 1.5 to 9 $g/m^2$.

11. The self-extinguishing cigarette of claim 9 wherein in the process for producing the coated cigarette paper, the aqueous cigarette paper coating composition is deposited onto said uncoated cigarette paper in a concentration in the range of from 3 to 7 $g/m^2$.

12. The self-extinguishing cigarette of claim 10 wherein in the process for producing the coated cigarette paper, the aqueous cigarette paper coating composition is deposited onto said uncoated cigarette paper by means of a flexography printing technique, in strips.

13. The self-extinguishing cigarette of claim 11 wherein in the process for producing the coated cigarette paper, the aqueous cigarette paper coating composition is deposited onto said uncoated cigarette paper by means of a flexography printing technique, in strips.

14. A self-extinguishing cigarette comprising tobacco and, as a wrapper, cigarette paper coated with a fire retardant and air permeability-reducing coating, said cigarette paper having (i) an external face and (ii) an internal face which is in contact with said tobacco, characterized in that the coated cigarette paper is produced according to the process comprising the steps of:

(A) preparing an aqueous cigarette paper coating composition consisting essentially of (I) 20% by weight acacia gum; (II) 10% by weight of aluminum hydroxide and (III) the remainder being water;

(B) providing an uncoated cigarette paper having an internal face and an external face; and (C) depositing the resulting aqueous cigarette paper coating composition onto the internal face of said uncoated cigarette paper in a concentration in the range of from 0.5 to 10 $gm/m^2$ by means of a flexography printing technique, in strips.

* * * * *

UNITED STATES PATENT AND TRADEMARK OFFICE

CERTIFICATE OF CORRECTION

PATENT NO. : 7,219,672 B2
APPLICATION NO. : 10/398310
DATED : May 22, 2007
INVENTOR(S) : Agustin Tosas Fuentes and Pablo De Mariscal Ruigomez It is certified that error appears in the above-identified patent and that said Letters Patent is hereby corrected as shown below:

On the Title Page, Item (75) Inventors:

In the Inventors section please delete "Austing Tosas Fuentes" and insert --Agustin Tosas Fuentes-- in its place.

In the Assignee section please delete "Miquel Y. Costas & Miquel S.A." and insert --Miquel y Costas & Miquel S.A.-- in its place.

Signed and Sealed this

Thirty-first Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 7,219,672 B2
APPLICATION NO. : 10/398310
DATED : May 22, 2007
INVENTOR(S) : Agusting Tosas Fuentes and Pablo De Mariscal Ruigomez It is certified that error appears in the above-identified patent and that said Letters Patent is hereby corrected as shown below:

Under item (74) on the front page of the patent please delete [Peterson L. Michaelson] and insert --Peter L. Michaelson-- in its place.

Signed and Sealed this

Eighth Day of April, 2008

JON W. DUDAS
*Director of the United States Patent and Trademark Office*